US009122224B2

(12) United States Patent
Sato

(10) Patent No.: US 9,122,224 B2
(45) Date of Patent: Sep. 1, 2015

(54) IMAGE FORMING APPARATUS AND POWER SUPPLY DEVICE

(71) Applicant: CANON KABUSHIKI KAISHA, Tokyo (JP)

(72) Inventor: Kei Sato, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/303,474

(22) Filed: Jun. 12, 2014

(65) Prior Publication Data

US 2014/0294423 A1 Oct. 2, 2014

Related U.S. Application Data

(63) Continuation of application No. 13/314,047, filed on Dec. 7, 2011, now Pat. No. 8,768,187.

(30) Foreign Application Priority Data

Dec. 15, 2010 (JP) ..... 2010-279885

(51) Int. Cl.
*G03G 15/00* (2006.01)

(52) U.S. Cl.
CPC ..... *G03G 15/80* (2013.01); *G03G 15/5004* (2013.01)

(58) Field of Classification Search
CPC ..... G03G 15/80; G03G 15/5004
USPC ..... 399/88, 89
See application file for complete search history.

(56) References Cited

FOREIGN PATENT DOCUMENTS

JP H041662 A 1/1992
JP 2000333459 A 11/2000

*Primary Examiner* — David Bolduc
*Assistant Examiner* — Barnabas Fekete
(74) *Attorney, Agent, or Firm* — Canon USA, Inc., IP Division

(57) ABSTRACT

A power supply device includes a first switch section that can disconnect a 24-V power supply from a commercial alternating-current (AC) power supply and that operates with the voltage of 3.3 V, and a second switch section that can disconnect a voltage detection circuit from the commercial AC power supply and that operates with the voltage of 3.3 V. When a power saving mode is on, the 24-V power supply and the voltage detection circuit are disconnected from the commercial AC power supply by using the first and second switch sections, whereby the power supply device can be used in areas where different supply voltages are used, and at the same time reduction in power consumption in the power saving mode is achieved.

19 Claims, 6 Drawing Sheets

IMAGE FORMING APPARATUS AND POWER SUPPLY DEVICE

CROSS-REFERENCE TO RELATED APPLICATION

This application is a Continuation of U.S. application Ser. No. 13/314,047 filed Dec. 7, 2011, which claims the benefit of Japanese Patent Application No. 2010-279885 filed Dec. 15, 2010, which is hereby incorporated by reference herein in its entirety.

BACKGROUND OF THE INVENTION

1. Field of the Invention

The present invention relates to image forming apparatuses, such as copiers and printers, which can be used in areas where different supply voltages are used, and to power supply devices which are suitable for being installed in the image forming apparatuses.

2. Description of the Related Art

Image forming apparatuses have power supply devices that convert voltages of a commercial alternating-current power supply (hereinafter, simply referred to as an AC power supply) into direct-current (DC) voltages. Different AC power supply voltages are used in different countries. AC power supply voltages are broadly classified into two systems: the 100 V system, such as 100 V or 120 V, which is used in Japan and North America, for example; and the 200 V system, such as 220 V or 240 V, which is used in Europe, for example. When AC power supply voltages having a large difference therebetween are used, conversion efficiencies, current ratings of components, and temperatures are required to satisfy the broad range of AC power supply voltages, resulting in difficulty in designing the configuration of an apparatus. Accordingly, two types of power supply devices are typically provided which have different configurations, each of which is optimized for a corresponding one of the 100 V system and the 200 V system.

However, since two types of power supply devices for the 100 V system and the 200 V system need to be provided, it is difficult to manage the production and inventories of the power supply devices. If a power supply device is compatible with both of the 100 V system and the 200 V system (hereinafter, such a power supply is referred to as a universal power supply device), only one type of power supply device is needed, achieving simplified management. A universal power supply has a configuration that has been optimized in accordance with the output voltage and output power. There is a method in which, when output power is small, the current ratings of components of a power supply for the 200 V system are increased so that the power supply is compatible with the 100 V system. Such a power supply employing this method is called a full-range power supply. In addition, Japanese Patent Laid-Open No. 2000-316280 describes a power supply that has a configuration in which a rectifier circuit outputs a voltage of the 200 V system regardless of the AC power supply voltage by changing the circuit configuration of the power supply. In this power supply, when an AC power supply voltage of the 100 V system is supplied, the circuit configuration is changed to perform voltage-doubler rectification to generate a voltage which is double the AC power supply voltage. When an AC power supply voltage of the 200 V system is supplied, the circuit configuration is changed to perform full-wave rectification to generate a voltage which is the same as the AC power supply voltage. Furthermore, this power supply includes a voltage detection circuit for detecting the voltage of the AC power supply, and is automatically switched to perform voltage-doubler rectification or full-wave rectification in accordance with the detected voltage.

A typical image forming apparatus has multiple power supplies because the image forming apparatus needs multiple voltages. Similarly, a universal power supply device has multiple universal power supplies having the above-described configurations.

To satisfy a recent demand for reducing power consumption, the following operations have been needed. A power saving mode is provided in an image forming apparatus. The image forming apparatus determines whether each of the circuits in the image forming apparatus needs to operate in the power saving mode or not, and turns off the circuits that do not need to operate in the power saving mode. To perform the above operations, the image forming apparatus needs to have a configuration in which the image forming apparatus individually turns the circuits on/off. Similarly, the universal power supply device desirably has a configuration in which power supplies that do not need to operate in the power saving mode can be stopped to achieve reduction in power consumption.

SUMMARY OF THE INVENTION

The present invention provides an image forming apparatus and a power supply device which can be used in areas where different supply voltages are used and which can reduce power consumption in a power saving mode.

According to an aspect of the present invention, there is provided an image forming apparatus including an image forming section configured to form a toner image on recording material; and a power supply section including a voltage detection circuit configured to detect a voltage of a commercial alternating-current power supply, a first power supply configured to convert the voltage of the commercial alternating-current power supply into a direct-current voltage and to output a first voltage, and a second power supply having a rectifier circuit configured to be switched between a full-wave rectification state and a voltage-doubler rectification state in accordance with an output of the voltage detection circuit, the second power supply being configured to convert the voltage of the commercial alternating-current power supply into a direct-current voltage and to output a second voltage. The image forming apparatus further includes a first switch section that is capable of disconnecting the second power supply from the commercial alternating-current power supply and that operates with the first voltage, and a second switch section that is capable of disconnecting the voltage detection circuit from the commercial alternating-current power supply and that operates with the first voltage. When the image forming apparatus is to be in the power saving mode, the second power supply is disconnected from the commercial alternating-current power supply by using the first switch section, and the voltage detection circuit is disconnected from the commercial alternating-current power supply by using the second switch section.

According to another aspect of the present invention, there is provided a power supply device including a voltage detection circuit configured to detect a voltage of a commercial alternating-current power supply; a first power supply configured to convert the voltage of the commercial alternating-current power supply into a direct-current voltage and to output a first voltage; a second power supply having a rectifier circuit configured to be switched between a full-wave rectification state and a voltage-doubler rectification state in accordance with an output of the voltage detection circuit, the second power supply being configured to convert the voltage of the commercial alternating-current power supply into a direct-current voltage and to output a second voltage; a first switch section configured to be capable of disconnecting the second power supply from the commercial alternating-current power supply and to operate with the first voltage; and a second switch section configured to be capable of disconnecting the voltage detection circuit from the commercial alternating-current power supply and to operate with the first voltage.

Further features of the present invention will become apparent from the following description of exemplary embodiments with reference to the attached drawings.

DESCRIPTION OF THE EMBODIMENTS

First Embodiment

Figure 1:
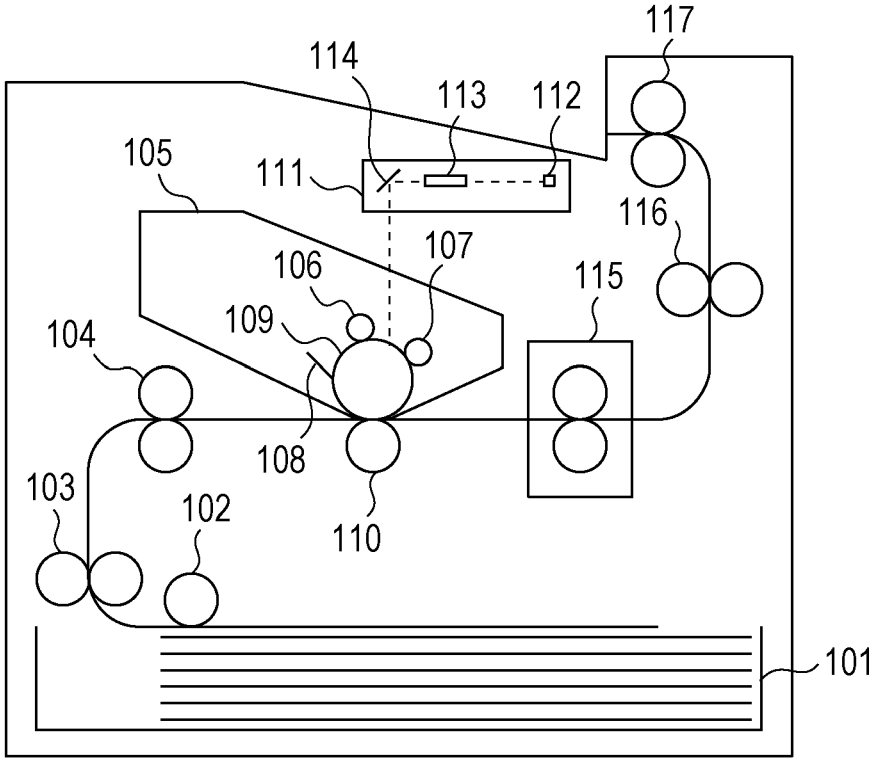
FIG. 1 is a diagram illustrating a configuration of an image forming apparatus according to an embodiment of the present invention.

FIG. 1 is a diagram illustrating a configuration of an image forming apparatus according to an embodiment of the present invention. Recording material is loaded in a paper feed cassette 101. A single sheet of the recording material is picked from the paper feed cassette 101 by a pickup roller 102, and is conveyed to registration rollers 104 by paper feed rollers 103. The sheet is further conveyed to a process cartridge 105 by the registration rollers 104 at a predetermined timing. The process cartridge 105 is a consumable unit including a charging unit 106, a developing roller 107 serving as a developing unit, a cleaner 108 serving as a cleaning unit, and a photosensitive drum 109 which is an electrophotographic photosensitive member. The process cartridge 105 is used for forming an unfixed toner image on a sheet of recording material by a known electrophotographic recording process. The surface of the photosensitive drum 109 is uniformly charged by the charging unit 106, and then an image is formed by exposure on the basis of image signals by a scanner unit 111 serving as an image exposure unit. A laser beam is emitted from a laser diode 112 included in the scanner unit 111. Scanning is performed with the laser beam in the main scanning direction by using a rotating polygonal mirror 113 and a reflecting mirror 114, and in the sub scanning direction by means of rotation of the photosensitive drum 109. As a result, a two-dimensional latent image is formed on the surface of the photosensitive drum 109. The latent image on the photosensitive drum 109 is made visible in the form of a toner image by the developing roller 107. The toner image is transferred onto the recording material conveyed from the registration rollers 104, by a transfer roller 110. The units described above are included in an image forming section for forming a toner image on a sheet of recording material.

The recording material having an toner image transferred thereonto is conveyed to a fixing device (fixing section) 115, and is subjected to a thermal fixing process. As a result, the unfixed toner image on the recording material is fixed onto the recording material. Then, the recording material is ejected by intermediate ejection rollers 116 and ejection rollers 117 to outside of the image forming apparatus body, and a sequence of the printing operations ends.

A power supply device (power supply section) included in the image forming apparatus has multiple power supplies for supplying necessary voltages to the units included in the image forming apparatus. For example, CPUs, sensors, and the like require a power supply of 3.3 V, and motors and fans require a power supply of 24 V. Accordingly, the power supply device has two power supplies of 3.3 V and 24 V. According to a first embodiment of the present invention, the image forming apparatus includes two power supplies that supply different output voltages. One of the power supplies is designed to be compatible with the entire range of alternating-current (AC) power supply voltages by using only a single configuration without changing the configuration of the power supply, for example. The other power supply is designed to be compatible with the entire range of AC power supply voltages by changing the configuration of the power supply in accordance with a supplied AC power supply voltage. The image forming apparatus can also reduce power consumption when a power saving mode is on.

Figure 2:
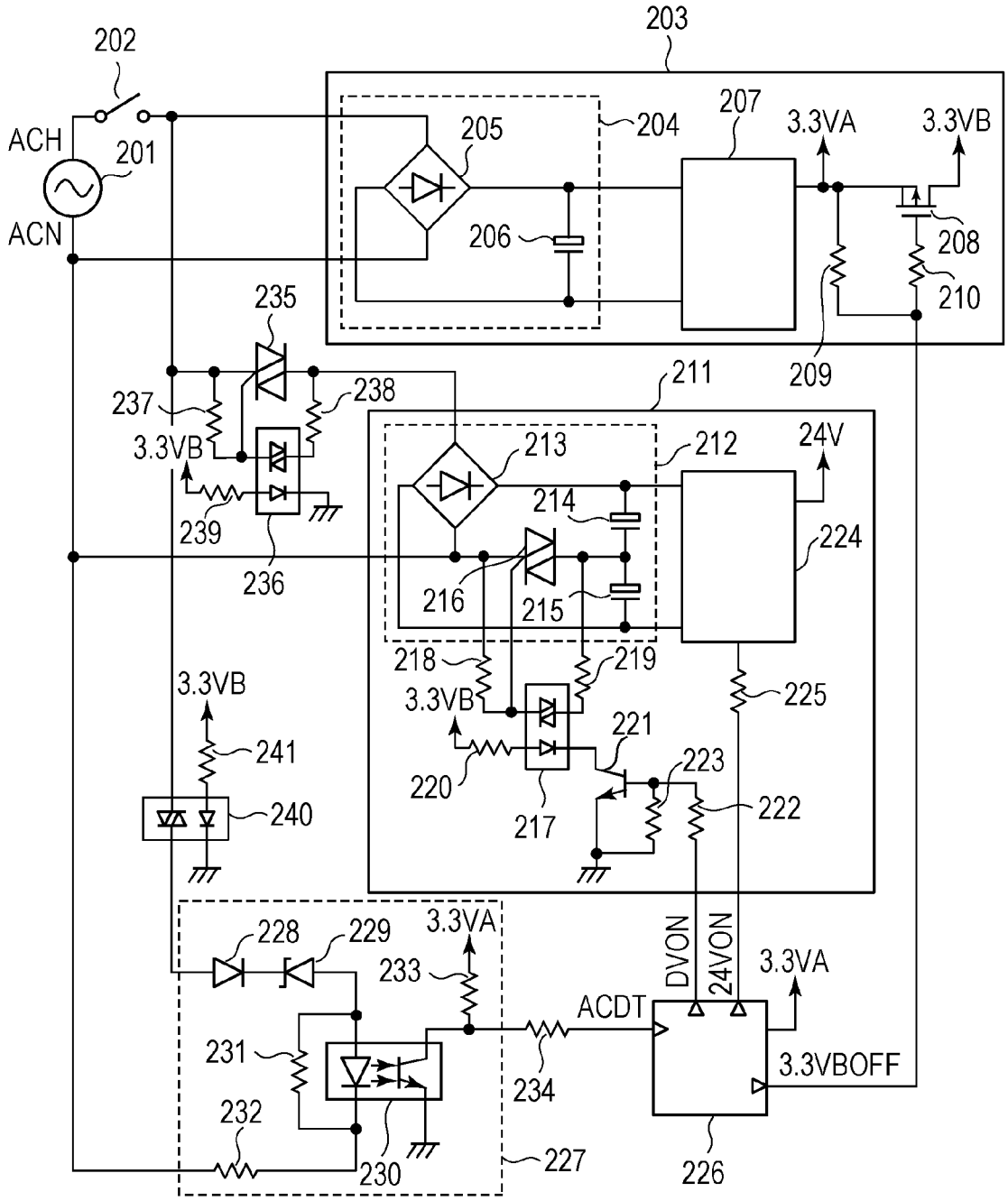
FIG. 2 is a diagram illustrating a configuration of a power supply device according to a first embodiment of the present invention.

FIG. 2 is a diagram illustrating a configuration of the power supply device of the image forming apparatus according to the first embodiment of the present invention. As described above, the power supply device includes a power supply 203 that outputs a direct-current (DC) voltage of 3.3 V (hereinafter, referred to as a 3.3-V power supply 203), and a power supply 211 that outputs a DC voltage of 24 V (hereinafter, referred to as a 24-V power supply 211). The 3.3-V power supply 203 serves as a first power supply that outputs 3.3 V (i.e., a first voltage) by converting the voltage of a commercial AC power supply to the DC voltage. The 24-V power supply 211 serves as a second power supply that outputs 24 V (i.e., a second voltage). The second power supply has a rectifier circuit that can be switched between a full-wave rectification state and a voltage-doubler rectification state in accordance with the output of a voltage detection circuit described below, and outputs the second voltage by converting the voltage of the commercial AC power supply to the DC voltage.

The 3.3-V power supply 203 includes a full-wave rectifier circuit 204 and a converter 207. The 3.3-V power supply 203 is a full-range power supply that is designed to be compatible with both the commercial AC voltage of the 100 V system and that of the 200 V system by using a single circuit configuration. The 3.3-V power supply 203 rectifies the full waves supplied from an AC power supply (commercial AC power supply) 201, by using a diode bridge 205, and smoothes the rectified waves into a DC voltage by using a smoothing capacitor 206. This DC voltage is converted into 3.3 V by the converter 207 and the resulting DC voltage is output. The voltage of 3.3 V is supplied to a CPU 226 or a sensor (not illustrated), for example. Since the output power is small, the above-described configuration can handle both the commercial AC voltage of the 100 V system and that of the 200 V system.

The 3.3-V power supply 203 is activated and outputs the voltage of 3.3 V when the image forming apparatus is connected to the AC power supply 201 and a power switch 202 is turned on. This voltage, which is represented by a voltage 3.3VA, is supplied to the CPU 226. The voltage 3.3VA is supplied through a field-effect transistor (FET) 208 to a path for outputting a voltage 3.3VB. When the CPU 226 sends a 3.3VBOFF signal that is set to low, the FET 208 is turned on to supply the voltage 3.3VA therethrough, and the voltage 3.3VB of 3.3 V is output. The voltage 3.3VB is used for controlling the power supply device when the power saving mode is to be on. When the output voltage 3.3VB is stopped, circuits that are connected to the path for the voltage 3.3VB are turned off, thereby reducing the power consumption of the image forming apparatus. On the other hand, the voltage 3.3VA that is continuously output is used for circuits, including a CPU, that need to operate even when the power saving mode is on.

Now, the 24-V power supply 211 will be described. Since the voltage of 24 V is supplied to motors, fans, and the like, the output power for the voltage of 24 V is high. Unlike the 3.3-V power supply 203, it is difficult to design the 24-V power supply 211 to be compatible with both the commercial AC voltage of the 100 V system and that of the 200 V system by using a single circuit configuration. Accordingly, the 24-V power supply 211 has a configuration in which a rectifier circuit 212 is switched between the voltage-doubler rectification state and the full-wave rectification state in accordance with the voltage of the AC power supply 201.

When the AC power supply 201 outputs the voltage of the 200 V system, a triac 216 is turned off. As a result, the rectifier circuit 212 serves as a full-wave rectifier circuit, and the waveform of the voltage of the AC power supply 201 is smoothed by using smoothing capacitors 214 and 215 which are connected in series. When the AC power supply 201 outputs the voltage of the 100 V system, the triac 216 is turned on. As a result, the rectifier circuit 212 serves as a voltage-doubler rectifier circuit. The smoothing capacitor 214 is charged by positive half-waves of the voltage of the AC power supply 201, whereas the smoothing capacitor 215 is charged by negative half-waves of the voltage of the AC power supply 201. Accordingly, a voltage which is double the peak voltage of the AC power supply 201 is generated across the smoothing capacitors 214 and 215 which are connected in series. Thus, the output of the rectifier circuit 212 (i.e., the input of a converter 224) will be the voltage of the 200 V system regardless of the voltage of the AC power supply 201 due to switching being performed between the rectification states in accordance with the voltage of the AC power supply 201. As a result, the converter 224 simply converts the voltage of the 200 V system into the DC voltage of 24 V and outputs the resulting DC voltage. The triac 216 is controlled by a phototriac coupler 217, thereby being turned on/off. The phototriac coupler 217 is connected to the CPU 226 via a transistor 221. When a DVON signal is set to high, the transistor 221, the phototriac coupler 217, and the triac 216 are turned on in this sequence. When a DVON signal is set to low, the transistor 221, the phototriac coupler 217, and the triac 216 are turned off in this sequence. In addition, to activate the converter 224 after the DVON signal is sent for switching between the voltage-doubler rectification state and the full-wave rectification state, the CPU 226 outputs a 24VON signal to the converter 224. When the 24VON signal is turned on, the converter 224 is turned on and outputs the voltage of 24V.

As described above, the triac 216 needs to be turned on/off in accordance with the voltage of the AC power supply 201 so that the 24-V power supply 211 is switched between the voltage-doubler rectification state and the full-wave rectification state. Therefore, a unit for detecting the voltage of the AC power supply 201 is required. A voltage detection circuit 227 will be described which detects the voltage of the AC power supply 201. Here, one of the terminals of the AC power supply 201 is on a Hot side (ACH), and the other terminal is on a Neutral side (ACN). When the ACH voltage becomes higher than the ACN voltage, a diode 228 is turned on. When the potential difference between ACH and ACN further becomes higher than the Zener voltage of a Zener diode 229, the Zener diode 229 is turned on and a light emitter of a photocoupler 230 emits light. When the light emitter of the photocoupler 230 emits light, a photo detector of the photocoupler 230 is turned on and an ACDT signal that is sent to the CPU 226 is set to low. When the potential difference between ACH and ACN becomes lower than the Zener voltage, the Zener diode 229 is turned off and the light emitter of the photocoupler 230 stops emitting light, whereby the photo detector is turned off and the ACDT signal is set to high. In other words, the ACDT signal is set to low during a period in which the ACH voltage is higher than the ACN voltage by the amount of the Zener voltage or greater. A higher voltage of the AC power supply 201 leads to a longer period in which the ACDT signal is set to low. Accordingly, the CPU 226 measures a time period in which the ACDT signal is set to low, thereby being able to estimate the voltage of the AC power supply 201. Thus, the CPU 226 determines whether the voltage of the 100 V system is being supplied or whether that of the 200 V system is being supplied.

In the power saving mode, motors and fans do not need to operate. Accordingly, the output voltage of 24 V may be stopped. Furthermore, when the 24-V power supply 211 is not used, the rectifier circuit 212 is not required to be switched between the voltage-doubler rectification state and the full-wave rectification state. Therefore, the voltage detection circuit 227, which is used for determining the timing of switching between the rectification states, may be stopped. To further reduce power consumption when the power saving mode is on, a switch for disconnecting the 24-V power supply 211 from the AC power supply 201, and a switch for disconnecting the voltage detection circuit 227 from the AC power supply 201 are provided. In the power saving mode, the 24-V power supply 211 and the voltage detection circuit 227 can be stopped by using the respective switches. When these switches are turned off, the 24-V power supply 211 and the voltage detection circuit 227 are stopped, and power consumption is reduced when the power saving mode is on.

In the first embodiment, a triac 235 is used as a switch for the 24-V power supply 211. The triac 235 serves as a first switch section that can disconnect the second power supply (i.e., the 24-V power supply 211) from the commercial AC power supply 201 and that operates with the first voltage (3.3 V). The triac 235 is controlled by a phototriac coupler 236 that is turned on/off in accordance with the presence/absence of the output voltage 3.3VB. Thus, when the output voltage 3.3VB is stopped, the triac 235 is turned off and the 24-V power supply 211 is stopped.

A phototriac coupler 240 is used as a switch for the voltage detection circuit 227. The phototriac coupler 240 serves as a second switch section that can disconnect the voltage detection circuit 227 from the commercial AC power supply 201 and that operates with the first voltage (3.3 V). When the voltage 3.3VB is output, the phototriac coupler 240 is turned on and the voltage detection circuit 227 is activated. When the output voltage 3.3VB is stopped in the power saving mode, the phototriac coupler 240 is turned off and the voltage detection circuit 227 is stopped. These switches may be relays, for example. However, these switches need to operate with the voltage of 3.3 V. The first embodiment employs a configuration in which the switches operate with the output voltage 3.3VB. However, the switches may operate with the output voltage 3.3VA. In this case, the phototriac couplers 236 and 240 are required to be connected to transistors so that the CPU 226 turns on/off the phototriac couplers 236 and 240.

A resistor 209 is a pull-up resistor for the 3.3VBOFF signal. A resistor 210 is a gate resistor for the FET 208. A diode bridge 213 performs full-wave rectification on the voltage of the AC power supply 201. Resistors 218 and 219 are bias resistors for the phototriac coupler 217. A resistor 220 is a current limiting resistor for a light emitting unit of the phototriac coupler 217. A resistor 222 is a base resistor for the transistor 221. A resistor 223 is a pull-down resistor for the DVON signal. A resistor 225 is a damping resistor for the 24VON signal. A resistor 231 is an inverse-voltage preventing resistor for the photocoupler 230. A resistor 232 is a current limiting resistor on the primary side of the voltage detection circuit 227. A resistor 233 is a pull-up resistor for the ACDT signal. A resistor 234 is a damping resistor for the ACDT signal. Resistors 237 and 238 are bias resistors for the phototriac coupler 236. A resistor 239 is a current limiting resistor for a light emitting unit of the phototriac coupler 236. A resistor 241 is a current limiting resistor for a light emitting unit of the phototriac coupler 240.

Figure 3:
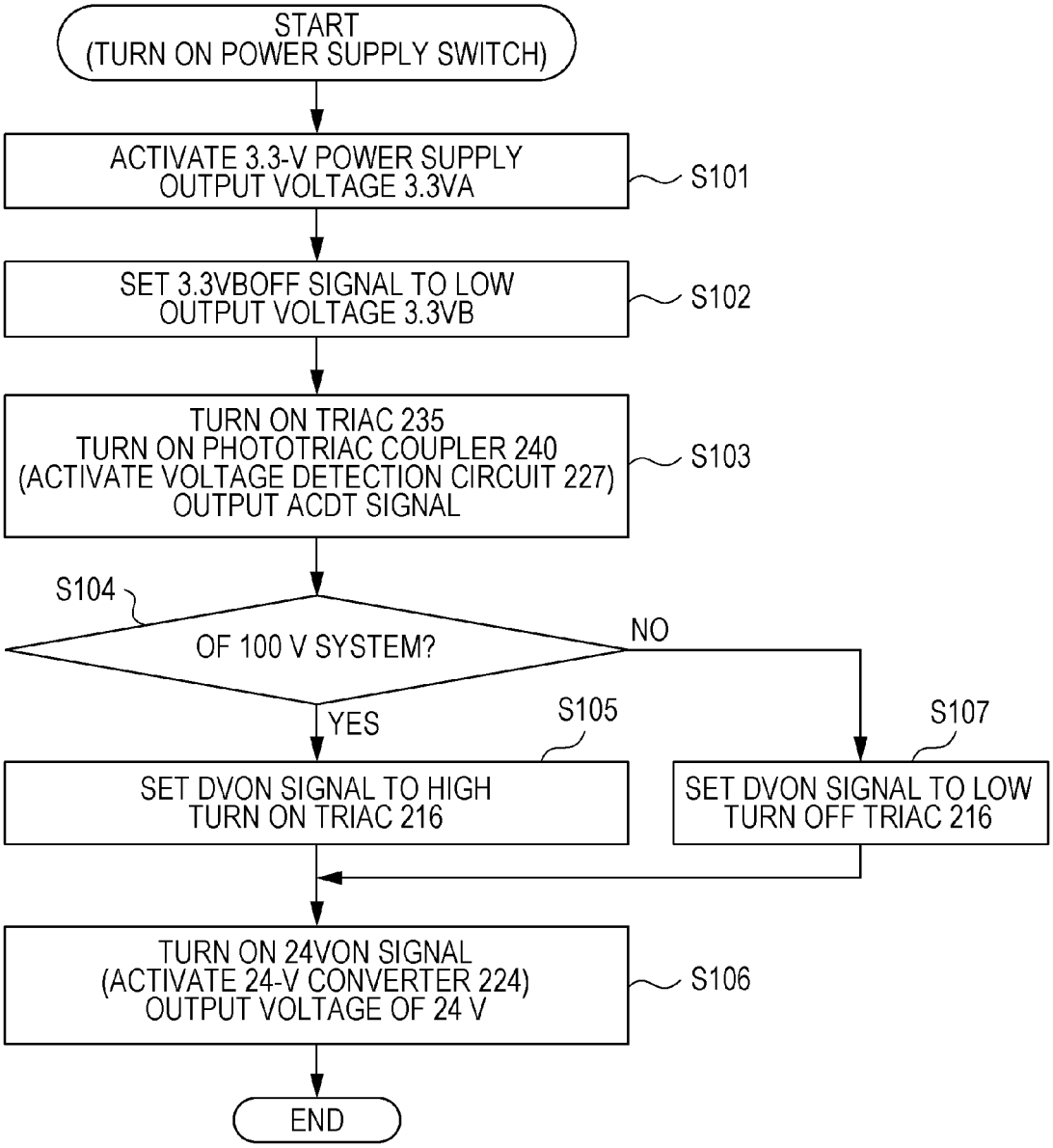
FIG. 3 is a flowchart of control of the power supply device after a power switch is turned on, according to the first embodiment of the present invention.

The control of the power supply device which is performed after the power switch 202 of the image forming apparatus is turned on will be described with reference to the flowchart in FIG. 3. When the power switch 202 is turned on, the 3.3-V power supply 203 is activated, the voltage 3.3VA is output, and the CPU 226 starts operating (step S101). When the CPU 226 starts operating, the CPU 226 sets the 3.3VBOFF signal to low, and the voltage 3.3VB is output (step S102). When the voltage 3.3VB is output, the triac 235 is turned on to connect the 24-V power supply 211 to the AC power supply 201, and the phototriac coupler 240 is turned on to cause the voltage detection circuit 227 to start operating (step S103). When the voltage detection circuit 227 starts operating, the CPU 226 estimates the voltage of the AC power supply 201 on the basis of the ACDT signal. When the CPU 226 determines that the voltage of the 100 V system has been supplied (YES in step S104), the CPU 226 sets the DVON signal to high. When the DVON signal is set to high, the triac 216 is turned on, and the rectifier circuit 212 in the 24-V power supply 211 is switched so as to perform the voltage-doubler rectification (step S105). When the CPU 226 turns on the 24VON signal to activate the converter 224, the voltage of 24V is output (step S106). When the CPU 226 determines that the voltage of the 200 V system has been supplied (NO in step S104), the CPU 226 sets the DVON signal to low to turn off the triac 216, so that the rectifier circuit 212 in the 24-V power supply 211 is switched so as to perform the full-wave rectification (step S107). Then, the CPU 226 turns on the 24VON signal to activate the converter 224, and the voltage of 24 V is output (step S106).

Figure 4:
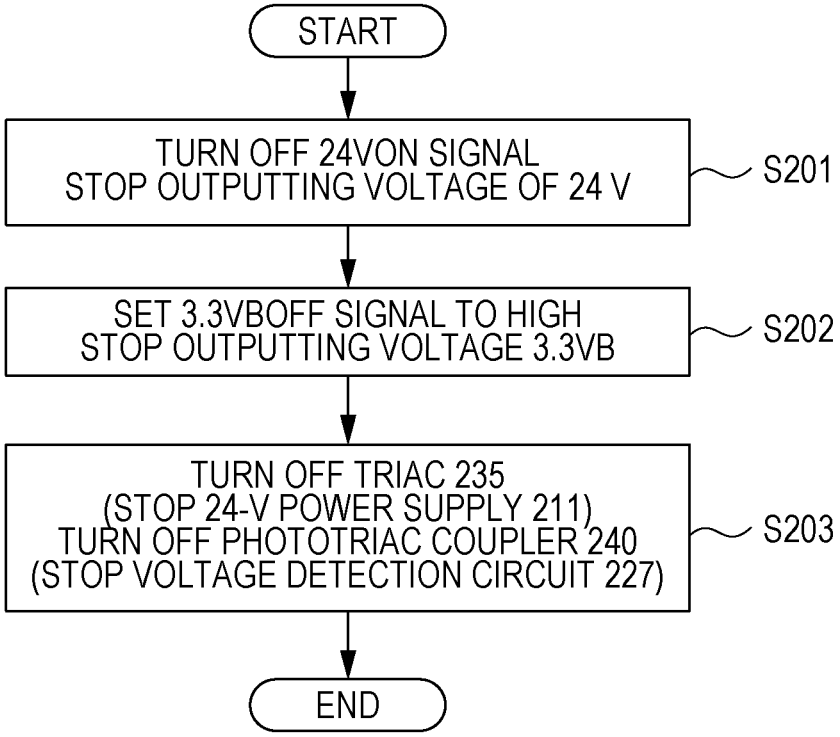
FIG. 4 is a flowchart of control of the power supply device when the image forming apparatus is to be switched to a power saving mode, according to the first embodiment of the present invention.

The control of the power supply device which is performed when the image forming apparatus is to be switched to the power saving mode will be described with reference to the flowchart in FIG. 4. When the image forming apparatus is to be switched to the power saving mode, the CPU 226 turns off the 24VON signal to stop the converter 224 which outputs the voltage of 24 V (step S201). The CPU 226 further sets the 3.3VBOFF signal to high to stop the output voltage 3.3VB (step S202). When the voltage 3.3VB is not output, the triac 235 and the phototriac coupler 240 are turned off, so that the 24-V power supply 211 and the voltage detection circuit 227 are stopped and the image forming apparatus is switched to the power saving mode (step S203). Thus, when the power saving mode is on, the 24-V power supply 211 and the voltage detection circuit 227 are completely stopped. As a result, the power consumption corresponding to the 24-V power supply 211 and the voltage detection circuit 227 is eliminated. Thus, when the image forming apparatus is in the power saving mode, the second power supply (i.e., the 24-V power supply 211) and the voltage detection circuit 227 are disconnected from the commercial AC power supply 201 by using the first and second switch sections 235 and 240 that operate with the first voltage (3.3 V).

As described above, the image forming apparatus according to the first embodiment has the power supply section which includes the 3.3-V power supply 203 that is a full-range power supply, the voltage detection circuit 227 that detects the voltage of the AC power supply 201, and the 24-V power supply 211 that allows the rectifier circuit 212 to be switched between the full-wave rectification state and the voltage-doubler rectification state in accordance with the voltage of the AC power supply 201. Furthermore, the 24-V power supply 211 and the voltage detection circuit 227 can be disconnected from the commercial AC power supply 201 in the power saving mode by using the switch sections that operate with the voltage of 3.3 V. Accordingly, an image forming apparatus and a power supply device can be provided which can be used in areas where different supply voltages are used and which can reduce power consumption in a power saving mode.

Second Embodiment

Figure 5:
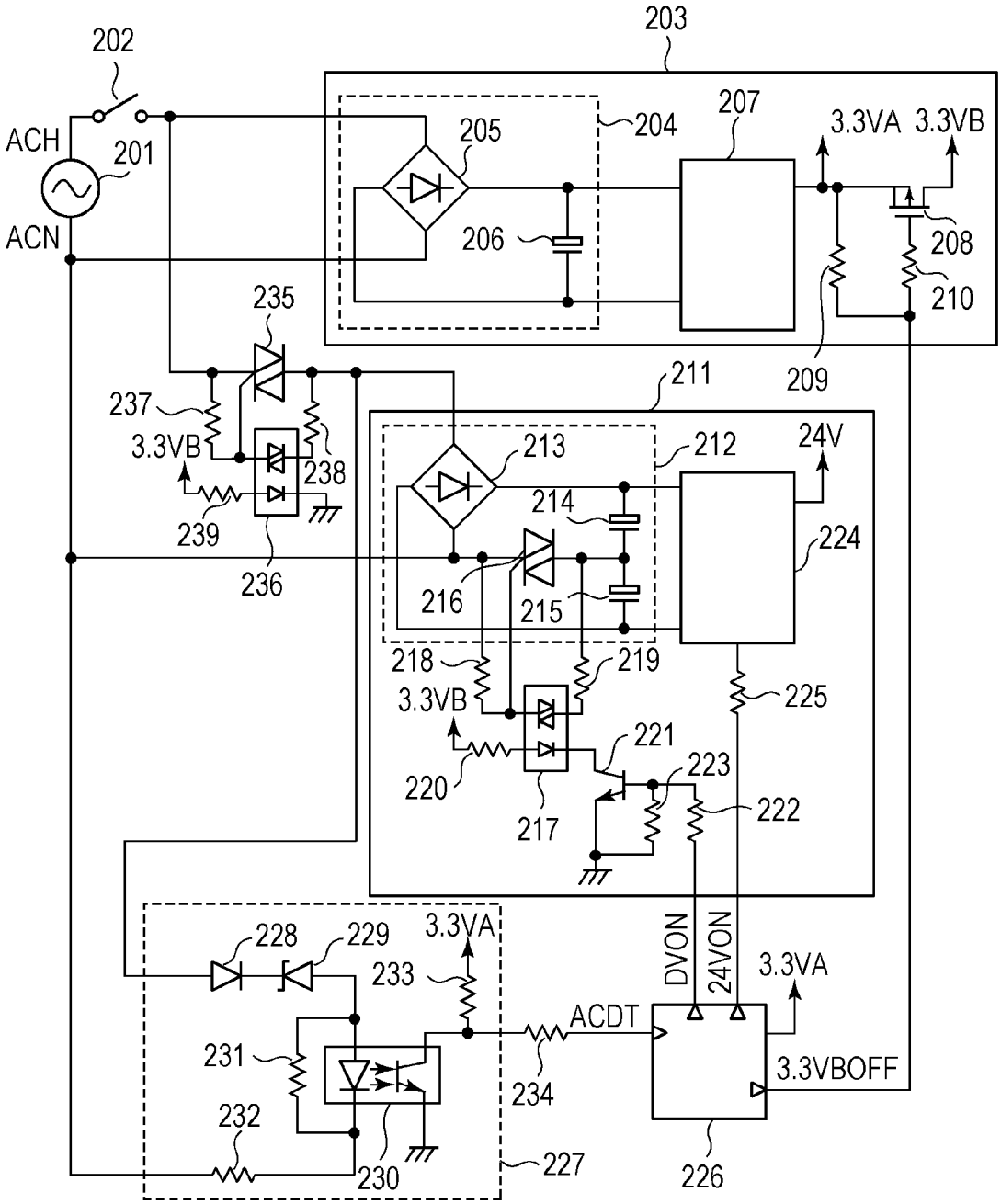
FIG. 5 is a diagram illustrating a configuration of a power supply device according to a second embodiment of the present invention.

FIG. 5 is a diagram illustrating a configuration of a power supply device (power supply section) of the image forming apparatus according to a second embodiment of the present invention. The second embodiment is characterized in that the switch (i.e., the first switch section) of the 24-V power supply 211 also serves as the switch (i.e., the second switch section) that connects/disconnects the voltage detection circuit 227 to/from the commercial AC power supply 201.

The 3.3-V power supply 203 of the second embodiment has the same configuration as that of the first embodiment, and will not be described. The 24-V power supply 211 of the second embodiment also has the same configuration as that of the first embodiment. In the second embodiment, the voltage detection circuit 227 is connected downstream of the triac 235 that is used for stopping the 24-V power supply 211. That is, the second power supply (i.e., the 24-V power supply 211) and the voltage detection circuit 227 are connected in parallel with each other downstream of the first switch section (i.e., the triac 235). When the power saving mode is on, the 24-V power supply 211 and the voltage detection circuit 227 can simultaneously be turned off by turning off the triac 235. Therefore, the second embodiment achieves power saving and also has a simpler configuration.

Thus, a switch is provided between the AC power supply 201 and the 24-V power supply 211. This switch operates with the voltage supplied by the 3.3-V power supply 203. The voltage detection circuit 227 is also provided downstream of the switch. In the power saving mode, when the switch is turned off, the 24-V power supply 211 and the voltage detection circuit 227 are stopped. Accordingly, the power consumption for this configuration is reduced and the configuration is simplified.

Third Embodiment

Figure 6:
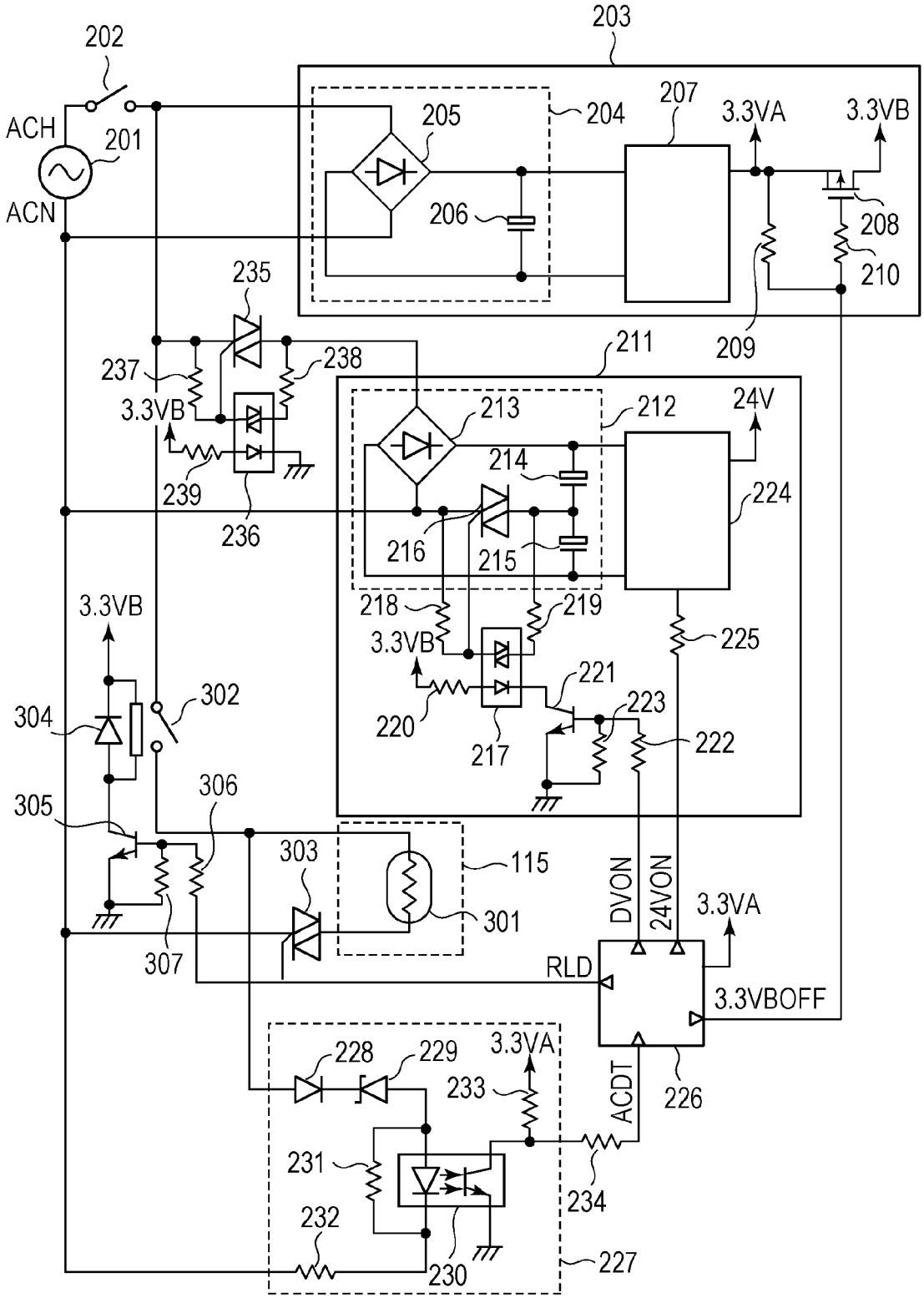
FIG. 6 is a diagram illustrating a configuration of a power supply device according to a third embodiment of the present invention.

FIG. 6 is a diagram illustrating a configuration of a power supply device of the image forming apparatus according to a third embodiment of the present invention. The third embodiment is characterized in that a relay that is used in a driving circuit for the fixing device also serves as the switch that connects/disconnects the voltage detection circuit 227 to/from the commercial AC power supply 201.

The basic configuration of the power supply section according to the third embodiment, which includes the 3.3-V power supply 203 and the 24-V power supply 211, is the same as that according to the first embodiment, and will not be described. The image forming apparatus includes the fixing device (fixing section) 115 for fixing a toner image onto recording material by means of heating. The fixing device 115 includes a heater 301 serving as a heating member that generates heat by using power supplied by the commercial AC power supply 201. A heater driving circuit, which supplies the heater 301 with power supplied from the AC power supply 201, has a relay (power interrupting member) 302 and a triac 303 which are disposed in the power supply path thereof. The relay 302 connects/disconnects the power supply path. The triac 303 controls the amount of power supplied to the heater 301. When a toner image is to be fixed, the CPU 226 causes the triac 303 to turn on/off so that a temperature of the heater 301 which is detected by a thermistor (not illustrated) is maintained at a target temperature. Thus, the power supplied to the heater 301 is controlled and the heater 301 is maintained at a target temperature that is appropriate for the fixing process. When the temperature detected by the thermistor becomes higher than a predetermined temperature, the relay 302 is turned off and the power is forced to be interrupted so that overheating of the heater 301 is prevented. In the third embodiment, the relay (power interrupting member) 302 also serves as the second switch section described in the first embodiment. The voltage detection circuit 227 is connected to the AC power supply 201 via the power interrupting member 302. The power interrupting member 302 operates with the first voltage (3.3 V).

When the power saving mode is on, the heater 301 will not be turned on. Accordingly, the relay 302 may be turned off. When a configuration is employed in which the voltage detection circuit 227 is connected downstream of the relay 302, the voltage detection circuit 227 as well as the heater driving circuit can simultaneously be turned off by turning off the relay 302. To employ such a configuration, a relay that typically operates with the voltage of 24 V is replaced with a relay that operates with the voltage of 3.3 V. When the CPU 226 sets the 3.3VBOFF signal to low and the voltage 3.3VB is output, the CPU 226 sets an RLD signal to high to turn on a transistor 305. Then, the relay 302 is turned on, and the voltage detection circuit 227 is activated and detects the voltage of the AC power supply 201. The CPU 226 causes the triac 216 of the 24-V power supply 211 to be turned on/off in accordance with the detected voltage of the AC power supply 201. As a result, the rectifier circuit 212 is switched to perform voltage-doubler rectification or full-wave rectification, and the voltage of 24 V is output. In the third embodiment, the voltage 3.3VB is used. Instead, the voltage 3.3VA may be used.

A diode 304 is a regenerative diode for the relay 302. A resistor 306 is a base resistor for the transistor 305. A resistor 307 is a pull-down resistor for the RLD signal.

The third embodiment is characterized in that a relay for the fixing device also serves as the switch for the voltage detection circuit 227. Therefore, the triac 235 disposed between the 24-V power supply 211 and the AC power supply 201 may or may not be provided. However, it is desirable that the triac 235 be provided to achieve a further reduction in power consumption.

As described above, the voltage detection circuit 227 is connected downstream of the relay 302 that is used for supplying/interrupting the power supplied to the heater 301 of the fixing device 115. When the power saving mode is to be on, the relay 302 is turned off. As a result, the power consumption corresponding to the heater driving circuit and the voltage detection circuit 227 can be eliminated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-279885 filed Dec. 15, 2010, which is hereby incorporated by reference herein in its entirety.

What is claimed is:

1. An image forming apparatus comprising:

an image forming section configured to form a toner image on recording material; and a power supply section including a voltage detection circuit configured to detect a voltage of a commercial alternating-current power supply, a first power supply configured to convert the voltage of the commercial alternating-current power supply into a direct-current voltage and to output a first voltage, a second power supply configured to convert the voltage of the commercial alternating-current power supply into a direct-current voltage and to output a second voltage larger than the first voltage, the second power supply being configured to switch between a first rectification state and a second rectification state in accordance with an output of the voltage detection circuit, a first switch section configured to be capable of disconnecting the second power supply from the commercial alternating-current power supply and that operates with the first voltage, and a second switch section configured to be capable of disconnecting the voltage detection circuit from the commercial alternating-current power supply and that operates with the first voltage, wherein when the image forming apparatus is to be in a power saving mode, the second power supply is disconnected from the commercial alternating-current power supply by using the first switch section, and the voltage detection circuit is disconnected from the commercial alternating-current power supply by using the second switch section.

2. The image forming apparatus according to claim 1, wherein the first voltage is 3.3V and the second voltage is 24V.

3. The image forming apparatus according to claim 1, wherein the first voltage is a voltage for driving a CPU, and second voltage is a voltage for driving a motor.

4. The image forming apparatus according to claim 1, wherein if the voltage detection circuit detects a voltage of 200V range, the second power supply is set to the first rectification state, and if the voltage detection circuit detects a voltage of 100V range, the second power supply is set to the second rectification state.

5. The image forming apparatus according to claim 4, wherein the first rectification state is a full-wave rectification state, and the second rectification state is a voltage-doubler rectification state.

6. The image forming apparatus according to claim 5, wherein the first power supply includes a full-wave rectification circuit.

7. The image forming apparatus according to claim 6, wherein the first power supply includes a first output for outputting the first voltage and a second output for outputting the first voltage, and wherein a CPU is driven by the first voltage outputted from the first output, and the first and second switch sections are driven by the first voltage outputted from the second output.

8. The image forming apparatus according to claim 7, wherein when the image forming apparatus is to be in the power saving mode, the second power supply and the voltage detection circuit are disconnected from the commercial alternating-current power supply by stopping an output from the second output.

9. The image forming apparatus according to claim 8, wherein when the image forming apparatus is to be in the power saving mode, an output from the first output is maintained.

10. The image forming apparatus according to claim 1, wherein the image forming apparatus further comprises a fixing section that includes a heating member which generates heat by using power supplied from the commercial alternating-current power supply and that fixes the toner image onto the recording material by means of heating, a power interrupting member is provided in a power supply path from the commercial alternating-current power supply to the heating member, the power interrupting member also serves as the second switch section, the voltage detection circuit is connected to the commercial alternating-current power supply via the power interrupting member, and the power interrupting member operates with the first voltage.

11. An image forming apparatus comprising:

an image forming section configured to form a toner image on recording material; and a power supply section including a voltage detection circuit configured to detect a voltage of a commercial alternating-current power supply, a first power supply configured to convert the voltage of the commercial alternating-current power supply into a direct-current voltage and to output a first voltage, a second power supply configured to convert the voltage of the commercial alternating-current power supply into a direct-current voltage and to output a second voltage larger than the first voltage, the second power supply being configured to switch between a first rectification state and a second rectification state in accordance with an output of the voltage detection circuit, a switch section configured to be capable of disconnecting the second power supply and the voltage detection circuit from the commercial alternating-current power supply and that operates with the first voltage, wherein when the image forming apparatus is to be in a power saving mode, the second power supply and the voltage detection circuit are disconnected from the commercial alternating-current power supply by using the switch section.

12. The image forming apparatus according to claim 11, wherein the first voltage is 3.3V and the second voltage is 24V.

13. The image forming apparatus according to claim 11, wherein the first voltage is a voltage for driving a CPU, and second voltage is a voltage for driving a motor.

14. The image forming apparatus according to claim 11, wherein if the voltage detection circuit detects a voltage of 200V range, the second power supply is set to the first rectification state, and if the voltage detection circuit detects a voltage of 100V range, the second power supply is set to the second rectification state.

15. The image forming apparatus according to claim 14, wherein the first rectification state is a full-wave rectification state, and the second rectification state is a voltage-doubler rectification state.

16. The image forming apparatus according to claim 15, wherein the first power supply includes a full-wave rectification circuit.

17. The image forming apparatus according to claim 16, wherein the first power supply includes a first output for outputting the first voltage and a second output for outputting the first voltage, and wherein a CPU is driven by the first voltage outputted from the first output, and the second switch section is driven by the first voltage outputted from the second output.

18. The image forming apparatus according to claim 17, wherein when the image forming apparatus is to be in the power saving mode, the second power supply and the voltage detection circuit are disconnected from the commercial alternating-current power supply by stopping an output from the second output.

19. The image forming apparatus according to claim 18, wherein when the image forming apparatus is to be in the power saving mode, an output from the first output is maintained.

* * * * *